United States Patent [19]

Marandel

[11] Patent Number: 5,029,882

[45] Date of Patent: Jul. 9, 1991

[54] ROLLER SKATES

[76] Inventor: Jean-Bernard Marandel, 4, rue de la Republique, L'ile Saint-Denis, France

[21] Appl. No.: 461,217

[22] Filed: Jan. 5, 1990

[51] Int. Cl.[5] ..... A63C 17/06

[52] U.S. Cl. ..... 280/11.2; 280/11.28

[58] Field of Search ..... 280/11.2, 11.21, 11.28, 280/11.27, 842; 188/2 R

[56] References Cited

U.S. PATENT DOCUMENTS

| | | | |
|---|---|---|---|
| 321,261 | 6/1885 | Turnbull | 280/11.2 |
| 906,281 | 12/1908 | Plimpton | 280/11.2 |
| 2,139,699 | 12/1938 | Segal | 280/11.2 |
| 2,179,592 | 11/1939 | Goettie | 280/11.2 |
| 2,653,821 | 9/1953 | Ware | 280/11.28 |
| 2,664,295 | 12/1953 | Van Horn | 280/11.28 |
| 3,288,251 | 11/1966 | Sakwa | 280/11.2 |
| 4,915,399 | 4/1990 | Marandel | 280/11.28 |

FOREIGN PATENT DOCUMENTS

| | | | |
|---|---|---|---|
| 416563 | 10/1910 | France | 280/11.28 |
| 2610208 | 8/1988 | France | 280/11.28 |
| 2633524 | 1/1990 | France | 280/11.28 |
| 418699 | 10/1934 | United Kingdom | 280/11.28 |

*Primary Examiner*—David M. Mitchell

*Attorney, Agent, or Firm*—Sughrue, Mion, Zinn, Macpeak & Seas

[57] ABSTRACT

A pair of roller skates each containing a shock-absorption device and an additional rear braking device. Each roller skate contains a member (2) which is fixed on the lower surface of the skate plate (3) and which is provided at both ends with removable pad devices (45) which absorb the shock due to the return of the articulated arm of the wheel axle-pivoting system (7, 7') and which are inserted in housings (43) of the member (20). The additional rear braking device is rotatably mounted on the rear of the plate (3) of each skate and is composed of a plate (42) which is grooved at its base (50) which bears against the rear wheel carriage under the action of the front brake pad (4) of the other skate.

8 Claims, 3 Drawing Sheets

ROLLER SKATES

The object of the present patent application is improvements in roller skates having suspension systems.

The invention relates to roller skates and to skateboards of the type in which the user places both feet on the board, and in which he controls progress through inclination of the board. These two types of roller equipment are hereinafter designated by the generic expression "roller skates".

The invention consists of improvements made to the suspension device, as well as an additional braking device, with said braking device being applicable only to roller skates in the conventional meaning of the term.

The direction system of the front and rear rolling carriage assemblies of the roller skate in accordance with the invention contains, for each assembly, an articulated arm which, after absorption of the shocks during the return of the arm to its normal position, abuts against a member which is fixed to the lower surface of the plate and which is provided with a metal pad. This shock-absorbing mechanism, initially provided with a metal pad, has been shown in use to have the double disadvantage of being noisy and, due to the shock against the articulated arm, of causing wear of the surfaces in contact with the pad and the articulated arm.

The object of the present invention is to overcome these disadvantages by providing means for limiting the shock intensity, preventing the wear of the contact surface of the articulated arm, absorbing the return shock and providing simple replacement of the pad.

In addition, in using the braking system situated at the front of the skate, it has been noted that, in practice, its operation was rendered difficult, if not impossible, at high speed. Moreover, with use, intense, rapid and uneven wear of the rubber covering component occurred.

It therefore appeared useful to add to the rear of the skate an additional braking device, cooperating with the principal front braking device, in the manner which will be described below.

The present invention relates to a roller skate of the type comprising a boot, fixed on a sole connected to a plate containing at the front a brake pad and containing front and rear rolling carriage assembly provided with a system for directing the wheels and containing a member fixed on the lower surface of the plate and provided at both ends with pads absorbing the shock from the articulated arms during their return to position.

In order to overcome the disadvantages cited above, the invention consists on the one hand of providing movable pads inserted in housings machined into the member, and on the other hand of providing an additional braking device at the rear of the plate for use in cooperation with the front brake pad of the other skate.

Other features and advantages of the present addition will become apparent from the following description of one embodiment of the invention, which is given as a non-limiting example and which refers to the attached drawings, in which:

DETAILED DESCRIPTION OF A PREFERRED EMBODIMENT

Figure 1:
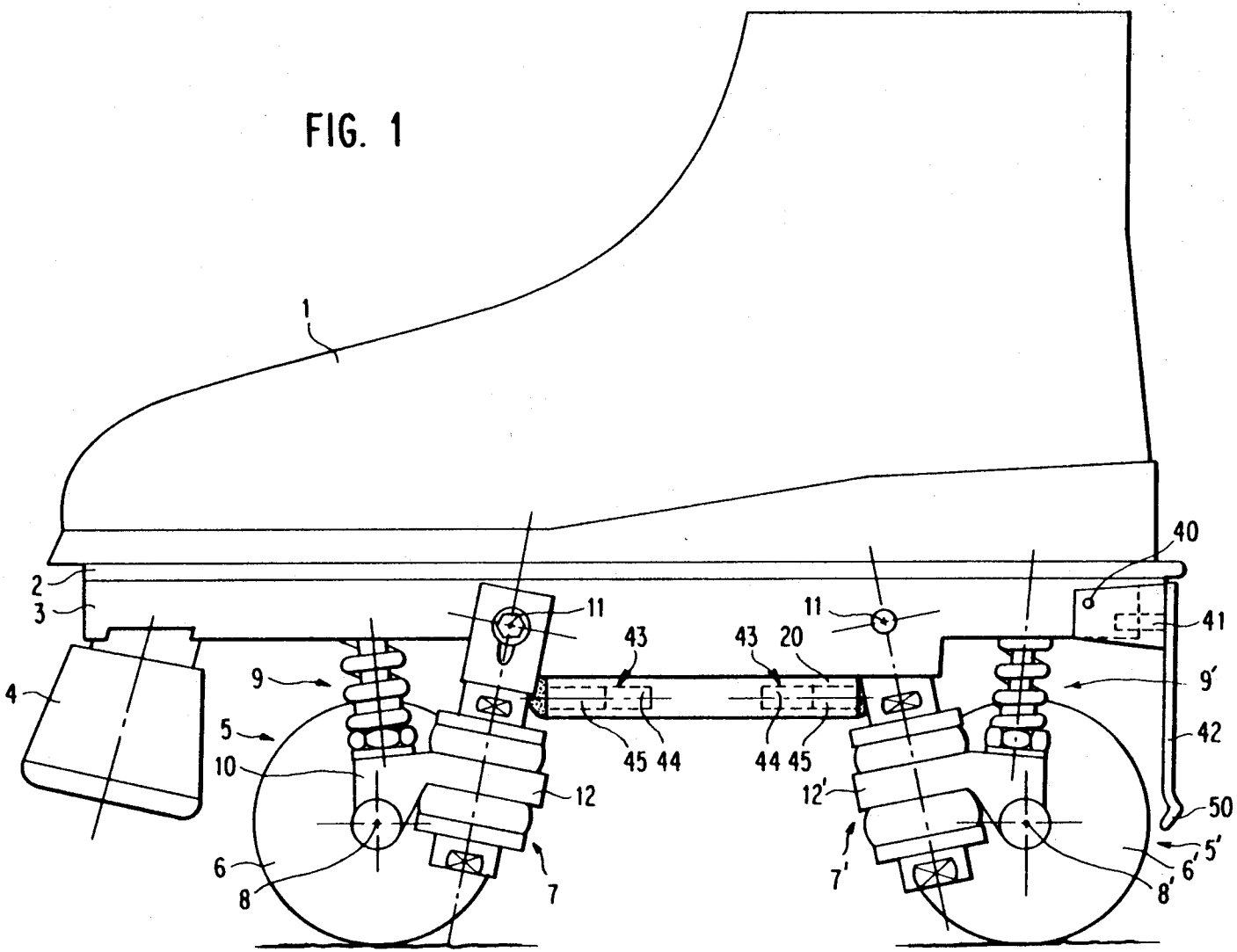
FIG. 1 is an elevation of the skate in accordance with the invention.

Referring to FIG. 1, it shows the roller skate, comprising a boot (1), fixed to the sole (2) connected to a plate (3) and containing at the front a brake (4) fixed to the plate (3). The skate further contains front and rear rolling carriage (5) and (5') respectively, provided with wheels (6) and (6') respectively, axle pivoting systems (7) and (7') for the wheels and pivotable wheel axis (8) and (8') provided with suspension systems (9) and (9') respectively.

Each suspension system (9, 9'), on the one hand, is fixed in the central part of the movable axis right to the axle of wheel (6 and 6') by an axle member (10, 10'), and on the other hand, is guided by a centering cylinder (17) placed in the plate (3). Each pivotable axle (8, 8') is provided with a pivoting system (7, 7') including an articulated arm (21') which is pivotably fixed at one end to the plate by pivot means (11, 11'), while the other end is connected to the axle arm (12, 12'), integral with the axle member (10') by resilient means in the form of two resilient washers between which the axle arm is sandwiched.

The foregoing skate construction is generally similar to that shown in my prior U.S. Pat. No. 4,915,399, issued Apr. 10, 1990.

The shock-absorbing mechanism is connected to a member (20), which is fixed to the lower part of the plate (3), and which is provided at both ends with pads (45) inserted in housings (43) which are partially occupied by springs (44).

The additional braking mechanism is connected to the rear part of the plate (3) by an axle (40) traversing said plate. It is composed of a plate (42) abutting against a resilient device (41) which is housed in a cavity machined in the rear surface of the plate.

Figure 2:
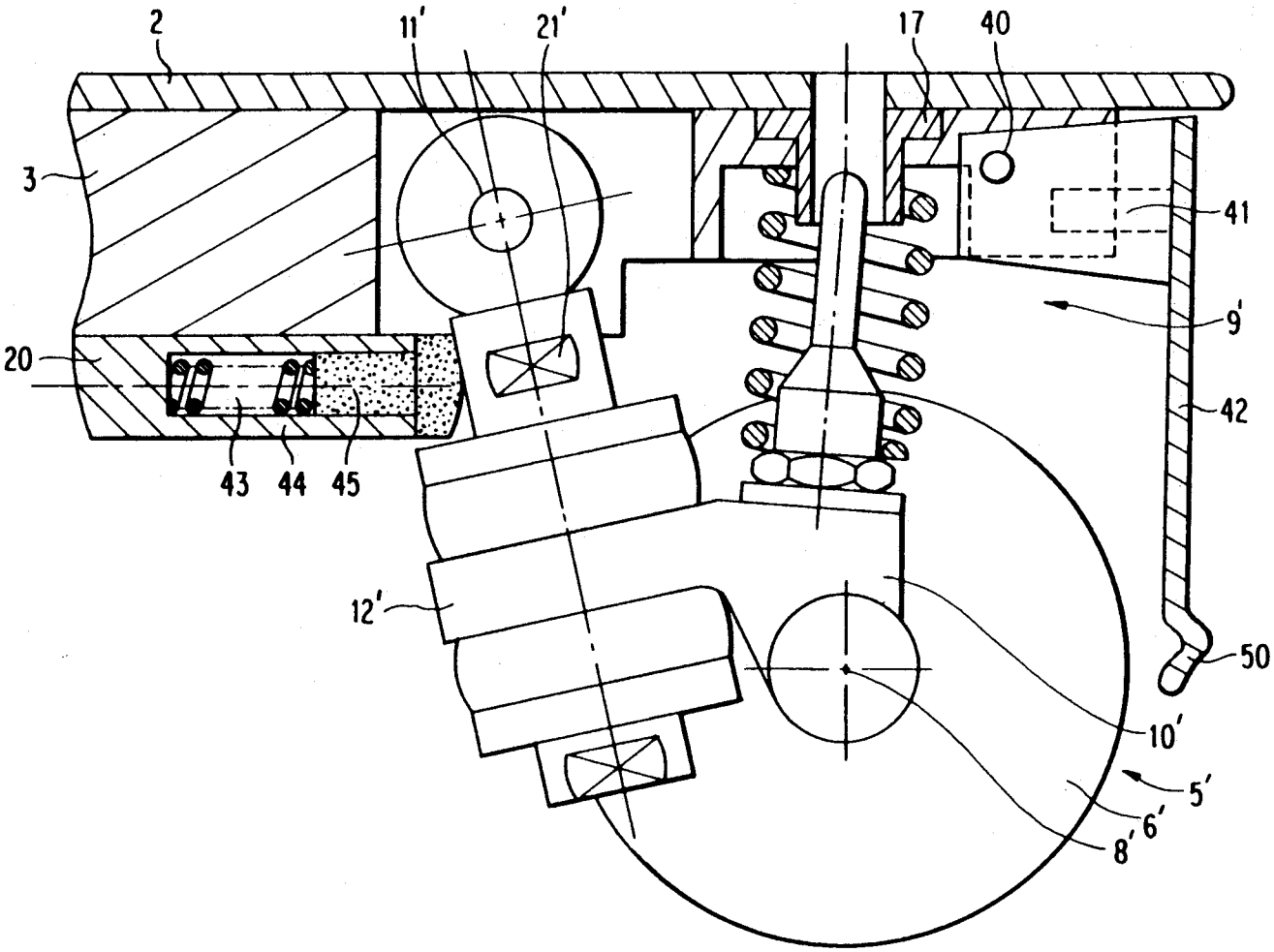
FIG. 2 is a detailed partial view representing, in cross-section along the longitudinal axis, the part constituting the rear gear of the skate, showing the shock-absorption system of the return of the articulated arm as well as the additional braking device.

Referring to FIG. 2, it shows in greater detail the shock-absorption system of the return of the rear articulated arm (21'). Said shock-absorption system is composed of: a helical spring (44), housed in the bottom of a cylindrical cavity (43) which is machined in the member (20) on the lower part of the plate (3); and a pad (45) inserted behind spring (44) in cavity (43) and provided with a head which projects externally and against which the surface of the articulated arm (21') of the rear axle abuts.

Referring to FIG. 1, it will be noted that an identical device is provided at the other end of the member (20) opposite the articulated arm of the carriage assembly of the front axle.

It will be noted that the member (20) can be connected to the plate (3) by any means, in particular by screws (not shown), in order to render it removable and easily permit the springs (44) and the pads (45) to be changed.

In a preferred embodiment, pad (45) will be composed of a synthetic material such as a hard plastic, rather than metal, in order to prevent any oxidation and surface marking of the articulated arm (21') which comes into contact therewith.

FIG. 2 also shows in greater detail the additional braking device and the method of fixing same. It will be described more completely by referring simultaneously to FIGS. 3 to 5.

Figure 3:
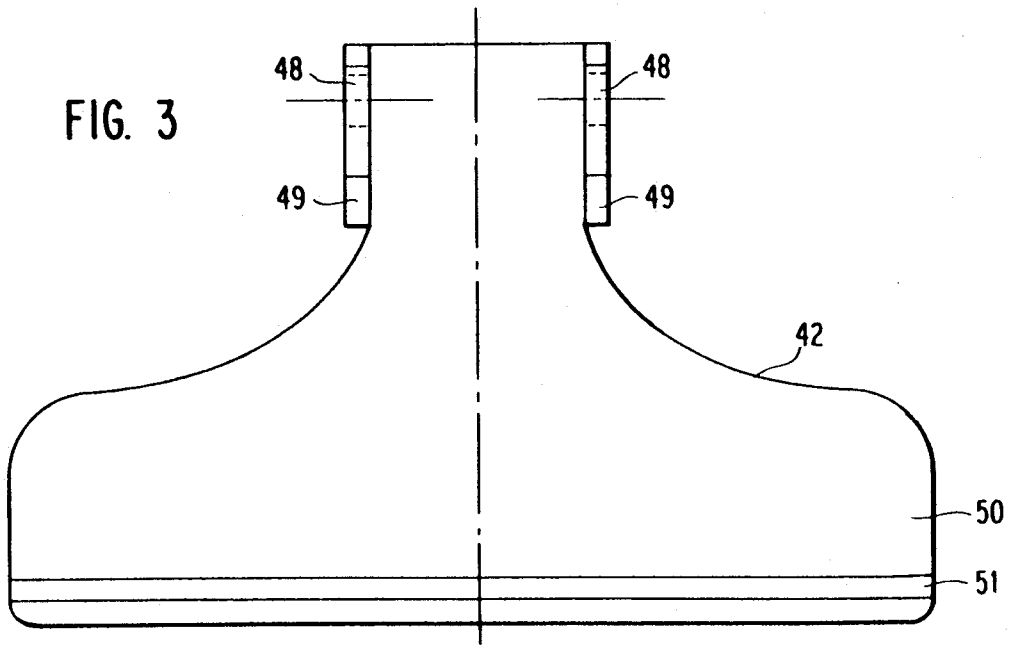
FIG. 3 shows a view of the rear surface of the braking device in accordance with the invention.

FIG. 3 shows the principal component (42) of the braking system, composed of a metal plate of a generally trapezoidal shape which has rounded angles on its large base (50). This base (50) contains a groove (51) which is parallel to said base and in which the concave part is directed towards wheel (6') opposite the rear rolling carriage assembly (5').

Figure 4:
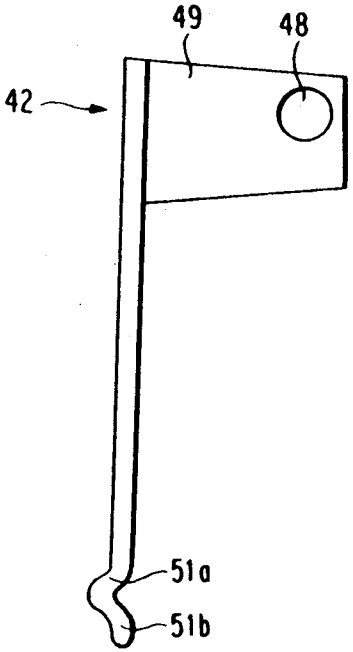
FIG. 4 shows a lateral view of the plate of the braking device in accordance with the invention.
Figure 5:
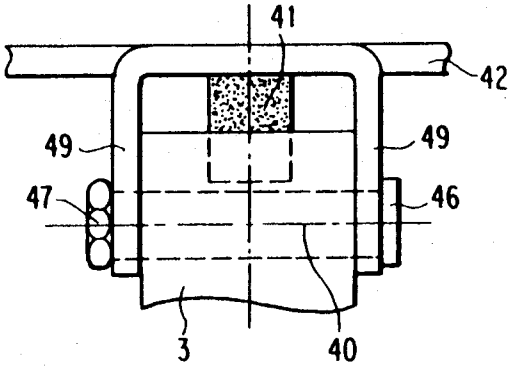
FIG. 5 shows the articulated fixing system of said brake plate to the skate plate.

This groove (51) has two functions: on the one hand, to provide the rigidity necessary for plate (42) and, on the other hand, to form two bosses (51*a* and 51*b*) over the entire length of the base, which are intended to come into contact with the rear wheels (6') over a relatively large area during braking (see FIGS. 2 and 4).

Plate (42) further contains two wings or flanges (49) which are pierced with orifices (48) and which are formed by bending the plate at 90°. Plate (42) is rotatably connected to the rear part of plate (3) by means of a threaded bolt (46) traversing the bore (40) of the plate and held in place by a nut (47).

A resilient device (41) (see FIGS. 2 and 5), housed in a cavity machined in plate (3) and projecting from the plate, acts as an abutment for the return of plate (42) to the vertical position after braking. This resilient device (41) is moved downwardly in relation to the rotation axis (40) of plate (42). It can be composed either of a rubber cylinder or of a helical spring.

This additional braking device (42) cooperates with the conventional brake-pad system (4) in the following manner: when the user wishes to brake, he simultaneously uses the additional rear brake device (42) of one of the skates and the front brake-pad (4) of the other skate, by putting his weight on the rear surface of the plate (42) in order to ensure contact of the two bosses (51*a* and 51*b*), provided in the base region (50) of the plate, with the rear wheels (6'). By bearing down more or less on the plate above brake (4') of the other skate, the user acts on the intensity of the braking force applied to wheels 6'.

It will, however, be noted that the details of shapes, sizes and respective arrangements of the various components can vary within compatible limits, without in any way changing the general conception of the invention described above.

Of course, the invention is not strictly limited to the embodiment chosen and it is possible to envisage other alternatives without departing from the framework of the invention.

I claim:

1. In a roller skate of the type having a shoe (1) fixed onto a sole (2) secured to a base (3), a front brake pad (4) secured to the front part of said base, front and rear undercarriages (5, 5') each with a pair of wheels (6, 6'), a pivoting system (7, 7') for each pair of wheels, and an axle (8, 8') for rotatably supporting each pair of wheels; wherein the front and rear axles are pivoting axles (8, 8') each of which is provided with a suspension system (9, 9'), the latter being secured at one end thereof on a central part (10, 10') of the pivoting axle, right to the axis of the wheels (6, 6'), and the opposite end thereof being guided by a centering barrel (17) located inside the base (3); wherein each pivoting axle is provided with a pivoting system (7, 7') comprising an articulated arm (21, 21') pivotally secured at an upper end thereof to the base (3) by pivot means (11, 11') while a lower end thereof is secured to an integral arm (12, 12') of the pivoting axle by resilient means; and wherein a member (20) fixed to the bottom surface of the base (3) is provided at both ends with buffer means (45) for damping shock by the articulated arms (21, 21') when the latter are returning to normal positions; the improvement:

wherein said buffer means comprises removable pads (45) inserted in housings (43) machined in said both ends, respectively, of said member (20); and comprising an additional braking means (42), rotatably mounted on the rear of said plate (3), for contacting said wheels (6') of said rear undercarriage (5') to brake said skate.

2. The roller skate in accordance with claim 1, wherein each of the removable pad devices comprises a rigid component (45) and a resilient component (44).

3. The roller skate in accordance with claim 2, wherein the rigid component (45) is a cylindrical, hard plastic component provided with a head projecting out of the respective housing (43), and wherein the resilient component inserted in the respective housing (43) is a helical spring (44).

4. The roller skate in accordance with claim 1, wherein the additional braking means comprises a brake plate (42) rotatably connected to the rear of the plate (3).

5. The roller skate in accordance with claim 4, wherein said brake plate comprises a base region (50), extending substantially parallel to said rear wheel axle (8'), and a groove (51) which is parallel to said base region, the concave part of said groove facing said rear wheels (6') and forming two bosses (51*a* and 51*b*) which bear against the rear wheels during a braking phase of the skate.

6. The roller skate in accordance with claim 5, wherein said additional braking means (42) comprises a resilient device (41) housed in a cavity machined in plate (3) and projecting therefrom, said resilient device acting as an abutment for the brake plate (42) after the braking phase.

7. The roller skate in accordance with claim 6, wherein the resilient device (41) is a helical spring.

8. The roller skate in accordance with claim 6, wherein the resilient device (41) is a cylindrical rubber component.

* * * * *